United States Patent [19]

Johnson

[11] Patent Number: 4,869,844

[45] Date of Patent: Sep. 26, 1989

[54] HIGH SOLIDS LIQUID ALKALINE CLEANERS

[75] Inventor: Mark D. Johnson, Cortland County, N.Y.

[73] Assignee: Pennwalt Corporation, Philadelphia, Pa.

[21] Appl. No.: 323,248

[22] Filed: Mar. 9, 1989

Related U.S. Application Data

[63] Continuation of Ser. No. 12,697, Feb. 9, 1987, abandoned.

[51] Int. Cl.[4] ..... C11D 7/06; C11D 7/14

[52] U.S. Cl. ..... 252/159; 252/156; 252/158; 252/174.13; 252/174.14; 252/174.15; 252/DIG. 14

[58] Field of Search ..... 252/156, 158, 159, 79.5, 252/174.13, 174.14, 174.15, DIG. 14

[56] References Cited

U.S. PATENT DOCUMENTS

| | | | |
|---|---|---|---|
| 2,738,294 | 3/1956 | Spence | 252/156 |
| 2,931,778 | 4/1960 | Ilenda et al. | 252/156 |
| 3,293,148 | 12/1966 | Dell et al. | 252/79.5 |
| 3,457,151 | 7/1969 | Kortejarvi | 204/130 |
| 3,583,923 | 6/1971 | Cantrell, Jr. et al. | 252/110 |
| 3,625,762 | 12/1971 | Kappas | 134/10 |
| 3,843,544 | 10/1974 | Kappas | 252/156 |
| 4,048,121 | 9/1977 | Chang | 252/527 |
| 4,390,465 | 6/1983 | Spekman | 252/527 |
| 4,521,332 | 6/1985 | Milova | 252/527 |
| 4,536,317 | 8/1985 | Llenado et al. | 252/174.17 |
| 4,556,504 | 12/1985 | Rek | 252/135 |
| 4,615,920 | 10/1986 | Baldi | 428/652 |
| 4,731,194 | 3/1988 | Rossmann et al. | 252/160 |

FOREIGN PATENT DOCUMENTS

| | | | |
|---|---|---|---|
| 1320919 | 6/1973 | United Kingdom | 252/135 |

OTHER PUBLICATIONS

*Chemistry and Industry*, Jul. 19, 1948, "The Theory and Practice of Metal Degreasing in Aqueous Media", P. D. Liddiard, pp. 435 to 437.

*Primary Examiner*—Paul Lieberman
*Assistant Examiner*—Kathleen Markowski

[57] ABSTRACT

An ultra-high solids, stable, liquid, highly alkaline caustic cleaner containing 40 to 80 weight percent total solids having 5 to 42 weight percent of an inorganic particulate material dispersed therein, such as an alkaline silicate, that is nonreactive and insoluble in the caustic of the composition.

30 Claims, No Drawings

HIGH SOLIDS LIQUID ALKALINE CLEANERS

This is a continuation of co-pending application Ser. No. 012,697 filed on Feb. 9, 1987 now abandoned.

BACKGROUND OF THE INVENTION

This invention relates to liquid, highly alkaline cleaners having a high solids content that are useful in such applications as in the production of finished steel.

For years, many industries have used liquid alkaline cleaners, normally based on sodium or potassium hydroxide, for various applications such as laundry, textile, maintenance and metalworking processes. A specific example of such an application is the alkaline cleaning of steel strip in the steel industry. Operations such as continuous and batch annealing, galvanizing and electrolytic plating require the complete removal of cold rolling lubricant residuals as the first step in their processes. In general, liquid cleaners have been preferred to powdered formulations for their ease of handling and inherent safety. Previous to this invention, the active content of these cleaners has been limited to approximately 50% by weight, with the balance composed of water. More highly concentrated versions of this class of cleaners are desirable as it reduces the volume of concentrate required to obtain a given cleaner bath concentration. This in turn reduces the end cost of the cleaner by minimizing the manufacturing, shipping and handling cost components. This invention permits the manufacture of liquid alkaline cleaners that contain as high as 80% active ingredients; furthermore, due to the basic chemical and physical properties upon which they are based, virtually unlimited combinations of normally employed alkaline cleaner additives can be used depending upon the intended application and performance specifications.

In addition to percent solids limitations, one of the major problems previous to this invention was the relatively low concentrations of inorganic alkaline silicates that could be incorporated into a high alkalinity liquid formula without destabilizing or gelling the cleaner. For example, using the conventional preparation procedure for a concentrated alkaline liquid which involves dissolving the caustic insoluble ingredients into a water based premix, adding the premix to the caustic base of the cleaner (normally 50% NaOH), mixing the combination for a specified time and set of conditions, and then sometimes homogenizing the final product by various mechanical means, the maximum amount of silicate that may be included has been approximately 5% on a $SiO_2$ basis.

Inorganic alkaline silicates as a general class are important ingredients for alkaline cleaning for at least two major reasons. First, in all alkaline cleaning applications, silicates are relatively inexpensive additives, yet exhibit good detergency, soil-suspension and surface-active properties. Where permitted, the inclusion of silicates in a formulation can significantly improve the cost-performance of an alkaline cleaner. Secondly, in metal cleaning, particularly for electrolytic cleaning, highly silicated alkaline cleaners deposit a thin layer of silicate onto the metal surface. This film is important in the cleaning of strip steel prior to batch annealing, where the silicate layer helps prevent the welding of adjacent coil laps during batch anneal -- a defect appropriately called "Stickers" in the industry vernacular.

Prior to this invention any cleaning operation requiring or desiring the use of a high silicate content, highly alkaline cleaner was forced to use a powdered form of cleaner. This invention provides a stable, highly silicated, high solids liquid alkaline cleaner composition and a method for manufacturing the composition. Using the method of this invention, a liquid alkaline cleaner can be produced with a $SiO_2$ content of 0–30%. By substituting phosphates, borates, carbonates or other cleaning additives that are insoluble and inert in concentrated liquid caustic solutions, almost any desired alkaline cleaning formulation can be produced in a highly concentrated liquid form.

The conventional manufacturing methods for the production of concentrated liquid alkaline cleaners involve the dissolution of the caustic insoluble ingredients, such as the organic additives (surfactants, chelating agents, foam controls, etc.) and the inorganic additives (silicates, phosphates, borates, etc.), into water as a premix. This conventional method cannot be used with high levels of the inorganic additives as these additives precipitate and the entire product then thickens beyond an acceptable point, sometimes resulting in complete solidification, when the premix is added to the caustic base and blended. Furthermore, using the quantity of water required to completely dissolve the additives in the premix severely limits the maximum attrainable solids content of the formulation. As an alternative conventional method of preparation, the addition of commercially available additives to the caustic base prior to premix addition or to a final blended product has also been largely unsuccessful, with the resulting blends having been found to be too unstable or thick to be practical.

SUMMARY OF THE INVENTION

The composition of the invention is defined as a free-flowing, liquid, highly alkaline, stable cleaner composition having a high total solids content within the range of about 40 weight percent to about 80 weight percent, said total solids include from about 20 to about 50 weight percent caustic based on total composition and a cleaning effective amount of an inorganic particulate material dispersed and suspended in the caustic, said inorganic material being both nonreactive and insoluble in said caustic of the composition.

The inorganic material is preferably present in an amount within the range of 5 to 30 weight percent of the composition and most preferably is sodium metasilicate.

The caustic preferably includes both NaOH and KOH with each present up to an amount sufficient to saturate the composition with NaOH and KOH.

The inorganic material is preferably suspended in the caustic and is made stable by making the particulate material of a small enough size preferably colloidal and/or by coating the small particles with a surface active agent to enable the particles to act as colloidal particles and remain in suspension, thereby creating a stable solution.

The caustic is preferably formed by mixing solid NaOH with an aqueous solution of KOH or vice versa. Such a procedure allows high caustic levels without lowering of the freezing point to unacceptable levels.

The method of manufacture of the invention is defined as the method for preparing a free-flowing, liquid, highly alkaline, stable cleaner composition which includes forming a solution of caustic of a concentration sufficient to provide from about 20 to about 50 weight percent caustic in the final composition and dispersing and suspending in the composition a cleaning effective amount of an inorganic particulate material, said inorganic material being both nonreactive and insoluble in said caustic of the composition.

The method of use of the composition of the invention is defined as a method of cleaning a metal surface which includes treating the surface for a sufficient period of time with a free-flowing, liquid, highly alkaline, stable cleaner composition having a high total solids content within the range of about 40 weight percent to about 80 weight percent, said total solids include from about 20 to about 50 weight percent caustic based on total composition and a cleaning effective amount of an inorganic particulate material dispersed and suspended in the caustic, said inorganic material being both nonreactive and insoluble in said caustic of the composition.

DETAILED DESCRIPTION OF THE INVENTION

This invention eliminates the previous instability, thickening and maximum solids limitations of conventional liquid compositions. Because powdered solid inorganic cleaner additives are only very slightly soluble or reactive, if at all, at lower temperatures with highly concentrated caustic solution (above 20%), these inorganic additives can be suspended and dispersed in caustic solutions containing sodium and/or potassium hydroxide using the teachings of this invention, without reacting to any appreciable extent, which reaction would cause the mixture to significantly thicken or solidify over time. Also, the smaller the size of insoluble particles in a liquid medium, the easier they are to disperse and suspend to form a stable colloidal-type suspension. Thus, if the particle size of the solid additives is reduced below a certain point, they can be dispersed and suspended in a highly caustic liquid medium with the aid of surfactants, protective colloids and other methods. The certain point for the particle size depends on many variables, including the density of the solid additives chosen, but can be determined through empirical formulation evaluation using standard sieves of known mesh to quantify the particle size range distribution of the additives prior to blending. Once a stable formula has been achieved, the data collected using the sieves can be used as a guideline for precise production specifications for a given formulation system.

To prepare high solids liquid alkaline cleaners of this invention, the procedure described below is utilized.

The caustic liquid, either potassium or sodium hydroxide is charged into the main blending vessel. Usually 50% sodium hydroxide or 45% potassium hydroxide is used as a base because they are readily available commercially and have acceptable freezing points. 70% sodium hydroxide or higher than 50% concentrations could be used as well, but the freezing point of liquid sodium hydroxide increases rapidly from 50-70%, which would require heated storage of the end product. Heated storage for such high solids formulae would be very difficult due to the accelerated evaporation of water.

To either liquid caustic base, the solid form of the other caustic base can be added directly into the main mixing vessel and dissolved. This can be done to the saturation point for either solid form. For example, using 50% NaOH as the base liquid, a 70%–50% NaOH/30% solid KOH mixture can be prepared that is stable and acts similarly to 50% NaOH with respect to freezing point. A similar blend can be prepared using 45% KOH as the base fluid and adding solid NaOH. This method of combining the two types of caustic aids to maximize the total solids content and alkalinity of the cleaner. The amount added depends on the physicall properties desired in the end product such as viscosity, alkalinity, specific gravity and pour point.

Next, the other caustic soluble additives are added and dissolved. The powdered, caustic insoluble, inorganic additives are added next with stirring in their desired quantities to form a slurry. Depending upon the additives used, the maximum amount added represents approximately 45% by weight. The smaller the particle size of the additives, the better the slurry stability and homogeneity. A ball or stone mill, or other means of mechanically grinding these solid additives can be used to improve the blend, but is not required. The invention requires that enough solid additives are charged to reach minimum viscosity that will support the final product as a stable suspension. Using a Brookfield Viscometer, this viscosity range is on the order of 200–500 cps with a No. 4 spindle at 100 rpm and 100° F.

Generally, any solid additive can be used as long as it will not react appreciably with the caustic fluid base over the storage time of the product. Examples of formula variations are included to demonstrate some of the ranges of this invention.

After preparing the slurry, a premix is then prepared in a second vessel which contains the organic and inorganic additives required to stabilize the slurry suspension. The composition and amount of premix required to stabilize the final product is highly variable, depending upon such factors as the particle size range and desnity of the solid slurry additives, the viscosity of the slurry and the desired viscosity of final product, and the water content of the product and its specific gravity. The function of the premix is to first coat the individual solid particles of the slurry. Then, since the premix ingredients are insoluble in the liquid caustic base, these organic and inorganic additives begin to precipitate or congeal at different rates around the solid particles to act as a protective colloid. The protective colloid is believed to function by reducing the density of the individual solid particles by coating them with the less dense congealed premix ingredients such as inorganic surfactants or inorganic phosphates or carbonates; and/or causing a thickening of the product by the formation of aggregate colonies of solid particles covered with the premix contents which reduces settling to insignificant levels while maintaining a free-flowing liquid product.

The composition of the premix is highly variable. Products have been successfully prepared using exclusively inorganic or organic additives. Normally, however, a combination of these two general classes is used to provide the best cleaning performance characteristics for the product.

Once the premix has been added to the main vessel with stirring, it is normally allowed to mix and react for a minimum of 20 minutes. As with the preparation of the premix and the slurry, no heating is required for the process. Although a certain amount of heat is generated by exotherms and mixing during the procedure, the maximum temperature experienced for the final blend has been 130° F. and no problems have been noticed at or below this temperature. Lower temperature is actually desirable to reduce the potential for reaction between the liquid caustic base and the other ingredients and to reduce the build up of scale in the mixing tank from dehydration. Also, a higher temperature can slow the complete precipitation and congealing of the premix, which potentially can result in the complete gelling of the final product in the shipping container when it finally cools.

The final blend can then be homogenized mechanically using standard colloid mills or other units which shear and grind the liquid to increase its stability. However, depending on the formulation of the product and the particle size range of the solid additives, this step is not necessary for the manufacture of a stable product. Homogenization, particularly where the unit employed has the capability to grind the solid particles to further reduce their size, as well as shear the liquid, can significantly reduce the amount of premix required to obtain a stable liquid cleaner. In fact, using a very efficient grinder, a stable product can be produced if the particle size range of the solid additives is reduced to a point where they act as colloidal particles themselves (see Example 4). The required particle size of the solid matter to yield a stable liquid depends on the viscosity, specific gravity and solids content of the liquid caustic base, but the maximum size is on the order of five microns or less. Therefore, under the proper conditions, this invention includes preparation of high solids liquid alkaline cleaners without the use of a premix.

Once homogenzied, if desired, the product is complete. The closer the final product is to ambient temperature when packaged, for reasons discussed earlier, the better and more consistent its shelf life. This type of product is a stable, viscous, free-flowing liquid with a high active ingredient content. It can be employed in any application that requires a highly alkaline cleaner. Therefore, it would find utiity in industries as diverse as metalworking, laundry, textiles or maintenance.

The stability and other characteristics of these formuations can vary considerably, as expected, depending upon their chemical composition and physical attributes. The minimum stability required to allow a product to be commercial is dependent upon the storage conditions and time period to which the product would be subjected. In certain applications where alkaline cleaner consumption is high, the material is appropriately purchased in bulk quantities and stored in large tanks equipped with agitators. Under these circumstances, a liquid cleaner formulation that exhibits less than 10% top layer separation without the formation of heavy bottom sedimentation after seven days of static storage is considered to meet the minimum stability requirements for a commercially viable product. Of course, during this period the product must not ungergo any significant changes in the chemical or physical characteristics. With the exception of the Example 4 non-premix, non-homogenized processed product, all of the products of the other examples met or exceeded this definition of stability.

In the Examples that follow, unless otherwise stated, the procedures specified above were utilized in blending and preparing the product of each Example.

EXAMPLES

EXAMPLE I

This Example uses only sodium hydroxide as the liquid caustic base, anhydrous sodium metasilicate fines as the solid slurry additive, and sodium hexametaphosphate and sodium carbonate (inorganics) in the premix. The small amount of 50% NaOH is added to the premix to neutralize the phosphate before adding the carbonate.

| Ingredients: | % by Weight |
|---|---|
| 50% NaOH | 53.68 |
| Anhydrous Sodium Metasilicate Fines ($Na_2SiO_3$) | 40.2 |
| Premix: Water | 3.35 |
| Sodium Hexametaphosphate | 1.67 |
| 50% NaOH | 0.1 |
| Sodium Carbonate | 1.0 |
| TOTAL | 100.0 |
| Properties: | |
| Appearance | Viscous Blueish-White Stable Colloidal Suspension |
| Pounds/Gallons (70° F.) | 14.9 |
| % Solids | 70 |
| Pour Point (°F.) approx. | 55 |
| Free Alkalinity, Phenolphthalein, % $Na_2O$ | 39.6 |
| Total Alkalinity, Methyl Orange, % $Na_2O$ | 41.5 |
| % $P_2O_5$ | 1.1 |
| % $SiO_2$ | 18.7 |
| Brookfield Viscosities (#4 Spindle at 100 rpm, cps) | |
| Without homogenization (97° F.) | 516 |
| Using 4" Colloid Mill* 0.001" Gap (110° F.) | 3,400 |
| Using 4" Colloid Mill 0.002" Gap (98° F.) | 2,767 |
| Using Supermill* - 85% Load $ZrSO_4$ (113° F.) at 2,000 fpm, 8.0 psig. | 3,040 |

*The Colloid Mill and Supermill are manufactured by Premier Mill Corporation. The Colloid Mill was equipped with KCD Fine Grit tooling and operated in all cases at 5,500 rpm.

EXAMPLE II

This Example uses a combination of potassium and sodium hydroxide as the liquid caustic base, anhydrous sodium metasilicate fines as the solid slurry additive, and a combination of inorganic/organic additives in the premix.

| Ingredients: | % by Weight |
|---|---|
| 45% KOH | 41.53 |
| Beaded, Solid NaOH | 15.38 |
| Anhydrous Sodium Metasilicate Fines ($Na_2SiO_3$) | 33.31 |
| Premix: Water | 5.34 |
| Sodium Hexametaphosphate | 1.14 |
| 50% NaOH | 0.62 |
| Anionic Phosphate Surfactant | 0.62 |
| Anionic Organic Surfactant | 1.06 |
| Sodium Carbonate | 0.62 |
| Foam Control 220[1] | 0.38 |
| TOTAL | 100.0 |
| Properties: | |
| Appearance | Viscous Blueish-White Stable Colloidal Suspension |
| Pounds/Gallon (70° F.) | 14.83 |
| % Solids | 72 |
| Pour Point (°F.) Less than | 10 |
| Free Alkalinity, Phenolphthalein, % $Na_2O$ | 37.7 |
| Total Alkalinity, Methyl Orange, % $Na_2O$ | 39.6 |
| % $P_2O_5$ | 0.8 |
| % $SiO_2$ | 15.5 |
| Brookfield Viscosities (#4 Spindle at 100 rpm, cps) | |
| Without homogenization (100° F.) | 480 |
| Using 4" Colloid Mill, 0.001" Gap (110° F.) | 500 |
| Using 4" Colloid Mill, 0.002" Gap (106° F.) | 540 |
| Using 4" Colloid Mill, 0.005" Gap (101° F.) | 480 |
| Supermill, 85% Load, 1.6–2.0 mm $ZrSO_4$ (87° F.) | 1,620 |

-continued

| Ingredients: | % by Weight |
|---|---|
| at 2,000 fpm, 5.0 psig. | |

[1]Product made by Pennwalt Corporation, Philadelphia, PA

EXAMPLE III

This Example uses a combination of sodium and potassium hydroxide for the liquid caustic base, a lesser amount of anhydrous sodium metasilicate and the addition of sodium carbonate as a filler for the solid slurry additives, with a combination inorganic/organic premix as specified below.

| Ingredients: | % by Weight |
|---|---|
| 45% KOH | 44.53 |
| Beaded Solid Caustic (NaOH) | 16.95 |
| Anhydrous Sodium Metasilicate Fines ($Na_2SiO_3$) | 10.54 |
| Light Density Sodium Carbonate | 18.13 |
| Premix: Water | 5.38 |
| Sodium Hexametaphosphate | 1.15 |
| 50% NaOH | 0.62 |
| Anionic Phosphate Surfactant | 0.62 |
| Anionic Surfactant | 1.08 |
| Sodium Carbonate | 0.62 |
| Foam Control 220 | 0.38 |
| TOTAL | 100.0 |
| Properties: | |
| Appearance | Viscous White Stable Colloidal Suspension |
| Pounds/Gallon | |
| % Solids | 70 |
| Pour Point (° F.) Less than | 10 |
| Free Alkalinity, Phenolphthalein, % $Na_2O$ | 34.2 |
| Total Alkalinity, Methyl Orange, % $Na_2O$ | 40.5 |
| % $P_2O_5$ | 0.8 |
| % $SiO_2$ | 4.9 |
| Brookfield Viscosities (#4 Spindle at 100 rpm, cps) | |
| Without homogenization (96° F.) | 240 |
| Using 4" Colloid Mill 0.001" Gap (110° F.) | 460 |
| Using 4" Colloid Mill 0.005" Gap (96° F.) | 420 |
| Using Supermill, 85% Load, 1.6–2.0 mm $ZrSO_4$ (78° F.) | |
| at 2,000 fpm at 4.0 psig; | 800 |
| at 3.5 psig | 880 |

EXAMPLE IV

This Example contains only 50% sodium hydroxide for the liquid caustic base and anhydrous sodium metasilicate as the solid slurry additive. No premix was used to determine if physical means alone, using a homogenizer, could form a stable product.

| Ingredients: | % by Weight |
|---|---|
| 50% NaOH | 57.12 |
| Anhydrous Sodium Metasilicate Fines ($Na_2SiO_3$) | 42.88 |
| TOTAL | 100.0 |
| Properties: | |
| Appearance | Blueish-White Viscous Liquid |
| Pounds/Gallon | |
| % Solids | 71.5 |
| Pour Point (° F.) approx. | 55 |
| Free Alkalinity, Phenolphthalein, % $Na_2O$ | 41.9 |
| Total Alkalinity, Methyl Orange, % $Na_2O$ | 43.5 |
| % $P_2O_5$ | 0 |
| % $SiO_2$ | 20 |
| Brookfield Viscosities (#4 Spindle at 100 rpm, cps) | |

-continued

| Ingredients: | % by Weight |
|---|---|
| Without homogenization (75° F.) | 460 |
| Using the 4" Colloid Mill, 0.001" Gap (76° F.) | 420 |
| Using the 4" Colloid Mill, 0.002" Gap | 321 |
| Using Supermill, 85% Load, 1.6–2.0 mm $ZrSO_4$ (108° F.) | |
| at 2,000 fpm at 7.0 psig; | 3,560 |
| at 8.0 psig (113° F.) | 2,761 |

This Example is the only Example that was not stable enought without homogenization to be considered a viable commerical product. Without homogenization, this product experienced gross separation within a matter of hours. Furthermore, even when homogenized using the Colloid Mill at either the 0.001" or 0.002" gap settings, the product still experienced greater than 20% separation within 24 hours. However, when this product was homogenized using the Supermill, a much more sever grinding mill, the resulting product experienced less than 5% separation within 24 hours. However, when this product was homogenized using the Supermill, a much more severe grinding mill, the resulting product experienced less than 5% separation over a period of one week. Although not completely stable, this product could be commercially viable if the storage container was equipped with a mixing device.

EXAMPLE V

This is an example of a phosphated-silicated formula using three types of phosphates.

| Ingredients: | % by Weight |
|---|---|
| 45% KOH | 42.09 |
| Beaded Solid NaOH | 16.04 |
| Crystalline Trisodium Phosphate ($Na_3PO_4$*$10H_2O$) | 8.15 |
| Anhydrous Sodium Tripolyphosphate | 5.21 |
| Anhydrous Sodium Metasilicate Fines | 20.71 |
| Premix: Water | 4.25 |
| Sodium Hexametaphosphate | 0.92 |
| 50% NaOH | 0.49 |
| Anionic Phosphate Surfactant | 0.49 |
| Anionic Surfactant | 0.86 |
| Sodium Carbonate | 0.49 |
| Foam Control 220 | 0.30 |
| TOTAL | 100.0 |
| Properties: | |
| Appearance | White Viscous Colloidal Suspension |
| Pounds/Gallon | 14.8 |
| % Solids | 67.8 |
| Pour Point (° F.) | Not Established |
| Free Alkalinity, Phenolphthalein, % $Na_2O$ | 33.2 |
| Total Alkalini:y, Methyl Orange, % $Na_2O$ | 35.5 |
| % $P_2O_5$ | 5.1 |
| % $SiO_2$ | 9.6 |
| Viscosity | Not Established |

I claim:

1. A free-flowing, liquid, highly alkaline, stable cleaner composition having a high total solids content within the range of about 60 weight percent to about 80 weight percent, said total solids include from about 20 to about 50 weight percent caustic based on total composition and a cleaning effective amount of at least 15 weight percent of an inorganic particulate material dispersed and suspended in the caustic, said inorganic material being both nonreactive and insoluble in said caustic of the composition.

2. The composition as defined in claim 1 wherein the inorganic material is present in an effective amount within the range of about 5 to 42 weight percent of total composition.

3. The composition as defined in claim 1 wherein said caustic includes KOH and NaOH.

4. The composition as defined in claim 3 wherein the KOH and NaOH are each present up to an amount sufficient to saturate the compostion with NaOH and KOH.

5. The composition as defined in claim 1 wherein said inorganic material is of a sufficiently small particle size to enable the material to remain suspended within the caustic.

6. The compostion as defined in claim 5 wherein the particles are colloidal in size.

7. The composition as defined in claim 1 wherein the inorganic particulate material is coated with a surface active agent to enable the material to remain dispersed within the caustic.

8. The composition as defined in claim 1 wherein the inorganic particulate material is an alkaline silicate.

9. The composition as defined in claim 8 wherein the silicate is sodium metasilicate.

10. The composition as defined in claim 1 wherein the inorganic particulate material is selected from the group consisting of phosphates and metasilicates.

11. The composition as defined in claim 1 wherein the inorganic particulate material is selected from the group consisting of sodium metasilicate, sodium tripolyphosphate, and sodium hexametaphosphate.

12. The composition as defined in claim 1 wherein said caustic is present within the range of 25 to 40 weight percent.

13. The composition as defined in claim 12 wherein said caustic includes NaOH and KOH and the particulate material includes sodium metasilicate.

14. The composition as defined in claim 13 wherein said particulate material is coated with an anionic surface active agent.

15. The composition as defined in claim 13 wherein the particulate material is sufficiently small in size to enable the material to remain suspended within the composition.

16. The method for preparing a free-flowing, liquid, highly alkaline, stable cleaner composition having a high total solids content within the range of about 60 weight percent to about 80 weight percent which solids include from about 20 to about 50 weight percent caustic based on total composition, which method includes forming a solution of caustic of a concentration sufficient to provide from about 20 to about 50 weight percent caustic in the final composition and dispersing and suspending in the composition a cleaning effective amount of at least 15 weight percent of an inorganic particulate material, said inorganic material being both nonreactive and insoluble in said caustic of the composition.

17. The method as defined in claim 16 wherein the inorganic material is present in an effective amount within the range of about 5 to about 42 weight percent of total composition.

18. The method as defined in claim 16 wherein said caustic includes KOH and NaOH in an amount of 25 to 40 weight percent of the composition.

19. The method as defined in claim 18 wherein the KOH and NaOH are each present up to an amount sufficient to saturate the composition with NaOH and KOH.

20. The method as defined in claim 16 wherein the caustic is prepared by mixing solid KOH and an aqueous NaOH solution.

21. The method as defined in claim 16 wherein the caustic is prepared by mixing solid NaOH and an aqueous KOH solution.

22. The method as defined in claim 16 wherein said inorganic material is of a sufficiently small particle size to enable the material to remain suspended within the composition.

23. The method as defined in claim 16 wherein the inorganic particulate material is coated with an anionic surface active agent by adding the agent to the caustic containing the inorganic material.

24. The method as defined in claim 23 wherein the caustic and inorganic material are then milled to further reduce to particle size of the inorganic material.

25. The method as defined in claim 16 wherein the inorganic particulate material is coated with a premix that includes a surface active agent to enable the material to remain dispersed within the composition.

26. The method as defined in claim 16 wherein the inorganic particulate material is an alkaline silicate.

27. The method as defined in claim 16 wherein said caustic is present in an amount within the range of 25 to 40 weight percent of the composition.

28. The method as defined in claim 27 wherein said caustic includes NaOH and KOH and the particulate material includes sodium metasilicate.

29. The method as defined in claim 27 wherein said particulate material is coated with an anionic surface active agent.

30. The method as defined in claim 27 wherein the caustic containing the inorganic particulate material is then milled to reduce the particle size of the inorganic material.

* * * * *